POLYCHLOROHYDRIN ETHERS OF TRIS-(HYDROXYMETHYL)-AMINOMETHANE IN ASSOCIATION WITH POLYGLYCOL DIAMINES

This application is a continuation-in-part of our application Ser. No. 703,751, filed July 9, 1976, now U.S. Pat. No. 4,059,631, which in turn is a divisional of our application Ser. No. 503,831, filed Sept. 6, 1974, and now U.S. Pat. No. 3,987,231.

The present invention relates to the treatment of synthetic, semi-synthetic or natural porous material, particularly fibrous material, to reduce the tendency thereof to accumulate static electricity.

Accordingly, the present invention provides a method of antistatically treating synthetic, semi-synthetic or natural porous material having a tendency to accumulate static electricity, which comprises applying thereto a compound of formula I,

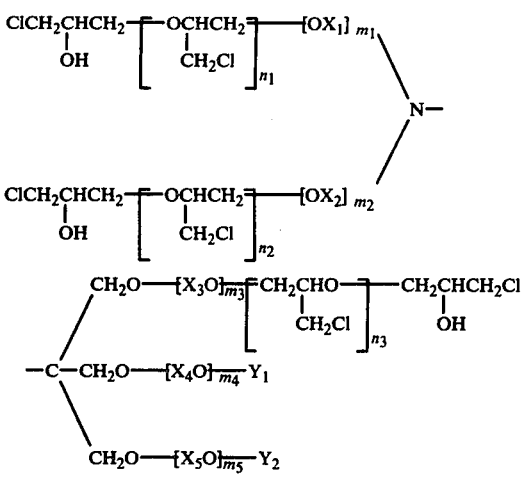

I wherein $X_1$, $X_2$, $X_3$, $X_4$ and $X_5$ are each, independently, 1,2-ethylene, 1,2-propylene or 1,2-butylene, $m_1$ and $m_2$ are each, independently, an integer 1 to 30, $m_3$, $m_4$ and $m_5$ are each, independently, 0 or an integer 1 to 30, $n_1$, $n_2$ and $n_3$ are each, independently, 0 or an integer 1 or 2, $Y_1$ is hydrogen or a radical of the formula

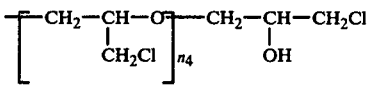

wherein $n_4$ is 0 or an integer 1 or 2, and $Y_2$ is hydrogen or a radical of the formula

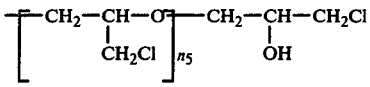

wherein $n_5$ is 0 or an integer 1 or 2, and wherein the sum of $m_1$, $m_2$, $m_3$, $m_4$ and $m_5$ is an integer 2 to 100 and the sum of $n_1$, $n_2$, $n_3$, $n_4$ and $n_5$ is 0 or an integer 1 to 7, in association with a compound of formula II,

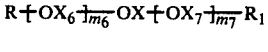

II wherein

R is a radical of the formula

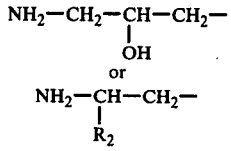

wherein $R_2$ is hydrogen, methyl or ethyl, $R_1$ is $NH_2$— or a radical of the formula

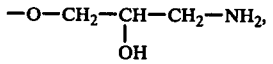

X is alkylene ($C_2$-$C_{12}$), phenylene, phenyleneoxyphenylene or phenylenesulphonylphenylene, $X_6$ and $X_7$ are each, independently, 1,2-ethylene, 1,2-propylene or 1,2-butylene, and $m_6$ and $m_7$ are each, independently, an integer 1 to 38, the sum of $m_6$ and $m_7$ being an integer 2 to 39, and/or a precondensate of the compounds of formulae I and II, and curing the applied compound(s) on the material.

In the formulae I and II above, when any of $X_1$, $X_2$, $X_3$, $X_4$, $X_5$, $X_6$ and $X_7$ is a 1,2-propylene or 1,2-butylene group, such group may be arranged either way round, i.e. as

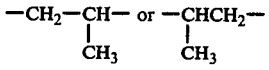

for 1,2-propylene and as

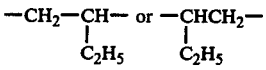

for 1,2-butylene.

Furthermore, when any one of $m_1$, $m_2$, $m_3$, $m_4$, $m_5$, $m_6$ and $m_7$ is greater than 1, the appropriate repeating units may be the same or different so that each chain

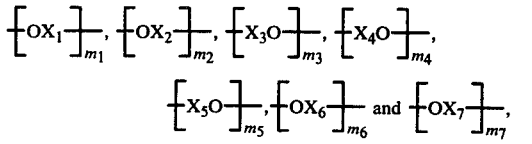

independently, may consist of a plurality of the same or different alkyleneoxy units. Moreover, when the repeating chain units are different, they may repeat in an ordered or random pattern.

As will be apparent from the description below, the compounds of formulae I and II and likewise the precondensates thereof are generally produced in the form of mixtures of compounds. While separation of such mixtures may in some cases be possible, in general it is found that such mixtures perform satisfactorily in the method of the invention and therefore separation is not

United States Patent [19]

Hochreuter

[11] 4,139,478

[45] Feb. 13, 1979

[54] POLYCHLOROHYDRIN ETHERS OF TRIS-(HYDROXYMETHYL)-AMINOMETHANE IN ASSOCIATION WITH POLYGLYCOL DIAMINES

[75] Inventor: Richard Hochreuter, Oberwil, Switzerland

[73] Assignee: Sandoz Ltd., Basel, Switzerland

[21] Appl. No.: 831,612

[22] Filed: Sep. 8, 1977

Related U.S. Application Data

[60] Continuation-in-part of Ser. No. 703,751, Jul. 9, 1976, Pat. No. 4,059,631, which is a division of Ser. No. 503,831, Sep. 6, 1974, Pat. No. 3,987,231.

[30] Foreign Application Priority Data

Sep. 6, 1973 [CH] Switzerland ..... 12813/73

[51] Int. Cl.[2] ..... D06M 13/18; D06M 13/16

[52] U.S. Cl. ..... 252/8.8; 252/8.9; 260/29.2 EP; 260/584 B; 427/386

[58] Field of Search ..... 252/8.8 R, 8.9; 260/29.2 EP

[56] References Cited

U.S. PATENT DOCUMENTS

| | | | |
|---|---|---|---|
| 2,355,337 | 8/1944 | Spence | 260/584 B |
| 2,829,071 | 4/1958 | Schroeder | 427/389 |
| 2,909,448 | 10/1959 | Schroeder | 427/389 |
| 3,121,749 | 2/1964 | Groote et al. | 260/584 |
| 3,121,750 | 2/1964 | Groote et al. | 260/584 |
| 3,238,087 | 3/1966 | Norwalk et al. | 427/390 |
| 3,240,721 | 3/1966 | Fordyce | 252/8.8 |
| 3,313,742 | 4/1967 | Durche | 252/8.8 |
| 3,441,435 | 4/1969 | Kirschnek et al. | 427/389 |
| 3,891,709 | 6/1975 | Higuchi et al. | 260/584 B |
| 3,894,070 | 7/1975 | Tomiyama et al. | 260/584 B |

FOREIGN PATENT DOCUMENTS

| | | | |
|---|---|---|---|
| 1308590 | 2/1973 | United Kingdom | 260/584 B |

*Primary Examiner*—Donald E. Czaja
*Assistant Examiner*—Maria S. Tungol
*Attorney, Agent, or Firm*—Gerald D. Sharkin; Richard E. Vila; Joseph J. Borovian

[57] ABSTRACT

The present invention concerns an application liquor for a novel method of antistatically treating synthetic, semi-synthetic or natural porous material, particularly fibrous material, which comprises a polychlorohydrin ether of tris-(hydroxymethyl)-aminomethane and a polyglycol diamine in an admixture and/or in partially condensed form.

24 Claims, No Drawings may be improved by an antistatic treatment of the material prior to or during dyeing.

Preferred compounds of formula I, either for use in the method of the invention or in the production of the precondensates of the invention, are the compounds wherein in formula I (i) the sum of $m_1$, $m_2$, $m_3$, $m_4$ and $m_5$ is an integer 2 to 20, particularly when each of $m_1$ and $m_2$ is independently an integer 1 to 4 and each of $m_3$, $m_4$ and $m_5$ is independently 0 or an integer 1 to 4;

(ii) $X_1$, $X_2$, $X_3$, $X_4$ and $X_5$ are each, independently, 1,2-ethylene or 1,2-propylene, more preferably 1,2-ethylene; and/or (iii) each of $n_1$, $n_2$, $n_3$, $n_4$ and $n_5$ is 0.

Thus, particularly preferred compounds are the compounds of formula Ia,

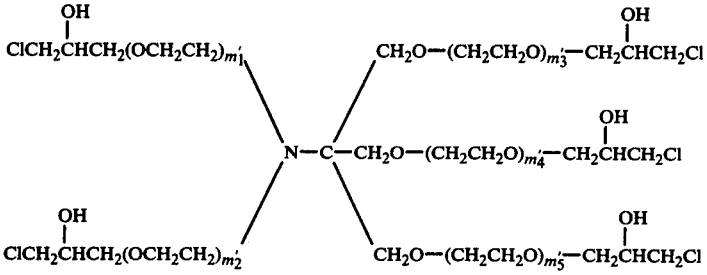

Ia wherein $m_1'$ and $m_2'$ are each, independently an integer 1 to 19, and $m_3'$, $m_4'$ and $m_5'$ are each, independently, 0 or an integer 1 to 18, the sum of $m_1'$, $m_2'$, $m_3'$, $m_4'$ and $m_5'$ being 2 to 20, especially the compounds wherein the sum of $m_1'$, $m_2'$, $m_3'$, $m_4'$ and $m_5'$ is 15.

Preferred compounds of formula II, either in the method of the invention or in the production of the precondensates of the invention are the compounds wherein (i) X is 1,2-ethylene, 1,2-propylene or 1,2-butylene, and, more preferably, each of X, $X_6$ and $X_7$ is, independently, 1,2-ethylene or 1,2-propylene, especially when X, $X_6$ and $X_7$ are the same;

(ii) the sum of $m_6$ and $m_7$ is an integer 4 to 22, especially 12 or 13; and/or (iii) R is a radical

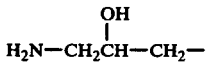

and/or $R_1$ is a radical

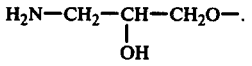

Thus, particularly preferred compounds of formula II are the compounds of formula IIa,

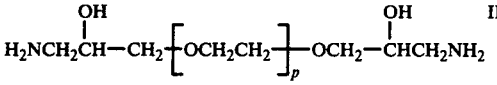

IIa wherein p is an integer 5 to 23, especially an integer 13 or 14.

The compounds of formula I are novel and also form part of the present invention. They may be produced, in accordance with a further aspect of the invention, by a process which comprises condensing a compound of formula III,

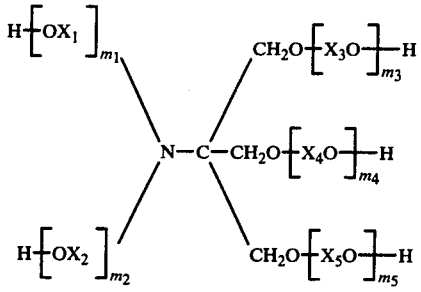

III wherein $X_1$, $X_2$, $X_3$, $X_4$, $X_5$, $m_1$, $m_2$, $m_3$, $m_4$ and $m_5$ are as defined above, with epichlorohydrin, in a molar ratio of 1:3 to 12 respectively.

The process may be effected by the addition of epichlorohydrin to the compound of formula III at a temperature between 90° and 110° C. Preferably a small amount, e.g. 1 to 3 percent by weight, based on the weight of the compound of formula III, of a condensation catalyst, especially a strong Lewis acid, in particular tin tetrachloride or boron trifluoride etherate, is added to assist the condensation. The reaction is allowed to proceed until no further epichlorohydrin distils off.

The compounds of formula III, employed as starting material in the production of the compounds of formula I, may be produced by alkoxylating a compound of formula IV,

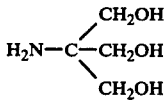

IV with one or more 1,2-alkylene oxides selected from 1,2-ethylene oxide, 1,2-propylene oxide and 1,2-butylene oxide in a molar ratio of compound of formula IV: total alkylene oxide of 1:2 to 100 respectively.

The reaction may be effected by the addition of the alkylene oxide to the compound of formula IV at a temperature of between 155° and 180° C., in the presence of a small amount, e.g. 1 to 2% by weight based on the weight of the compound of formula IV, of an alkali, for example, sodium hydroxide, and the reaction allowed to proceed at the above temperature for a sufficient period to allow complete alkoxylation.

In practice, it is not necessary to isolate the resulting compounds of formula III, the reaction mixture being employed directly in the production of compounds of formula I by reducing the temperature thereof to 90° to 110° C. and addition thereto of epichlorohydrin together with, if required, a condensation catalyst.

The compounds of formula II, employed in the method or in the production of the precondensate of the invention, may be produced by alkoxylating a compound of formula V, $$HO-X-OH \qquad V$$

wherein X is as defined above, with one or more 1,2-alkylene oxides selected from ethylene oxide, propylene oxide and 1,2-butylene oxide, in a molar ratio of compound of formula V: total alkylene oxide of 1:2 to 39 (or 1:2 to 40 when R is a radical $$-CH_2\underset{\underset{R_2}{|}}{C}HNH_2)$$

respectively, to produce an alkoxide adduct, e.g. polyglycol 600, and a. converting at least one terminal —OH group of the resulting alkoxide adduct to a more reactive group, e.g. chlorine, and condensing with ammonia and/or b. condensing the resulting alkoxide adduct or a monoaminated product from (a) above with epichlorohydrin and converting the terminal chlorine atom(s) of the resulting product to amino group(s) by reaction with ammonia.

The alkoxylation of the compound of formula V to produce the alkoxide adduct may be effected in manner known per se, e.g. by adding the alkylene oxide to the diol of formula V, at an elevated temperature, e.g. 220°-240° C. The resulting alkylene oxide adduct is then reacted with, for example, a chlorinating agent, such as thionyl chloride in accordance with process variant (a) or with epichlorohydrin at an elevated temperature, e.g. 70° to 80° C., in the presence of a strong Lewis acid as catalyst, e.g. tin tetrachloride or boron trifluoride etherate in accordance with process variant (b). The terminal chlorine atoms in each of the resulting products are converted to amino groups by adding thereto an aqueous ammonia solution at a temperature of from 15° to 25° C. in the presence of an alkali, e.g. sodium hydroxide.

Examples of compounds of formula V are 1,2-ethylene glycol, 1,3-propylene glycol, 1,4-butylene glycol, 1,5-pentamethylene glycol, 1,6-hexamethylene glycol, 1,10-decamethylene glycol, 4-hydroxyphenol, 4,4'-dihydroxy diphenylether and 4,4'-dihydroxy diphenylsulphone. Of the alkylene oxides mentioned above as alkoxylating agents, ethylene oxide and propylene oxide are preferred.

In the following Examples, which illustrate the invention, parts and percentages are by weight and the temperatures are in degrees Centigrade.

EXAMPLE 1 a. Compound of formula I

A polychlorohydrin ether of formula I is produced by alkoxylating 121 parts (1 mol) of tris-(hydroxymethyl)-aminomethane with 145 parts (2.5 mols) of propylene oxide at a temperature of between 155° to 175°. When alkoxylation is complete, 462 parts (5 mols) of epichlorohydrin and 2.1 parts of tin tetrachloride are added to the reaction mixture containing the resulting propylene oxide adduct, the temperature being maintained at 95° to 100° C. throughout the reaction.

The structure of the compound produced corresponds to formula I wherein $n_1$ to $n_5$ are each 0, the sum of $m_1$ to $m_5$ is 3, $X_1$ and $X_2$ are each 1,2-propylene and $Y_1$ and $Y_2$ are each $$-CH_2-\overset{\overset{OH}{|}}{C}H-CH_2Cl.$$

b. Compound of formula II

A polyglycol diamine of formula II is produced by condensing 300 parts (0.5 mols) polyglycol 600 in the presence of 3 parts tin tetrachloride at 75° with 92.5 parts (1 mol) epichlorohydrin. The resultant polyglycol bis-epichlorohydrin ether is then added at 20° to 25° to a mixture consisting of 126 parts 30% aqueous sodium hydroxide solution and 136 parts 25% aqueous ammonia solution. The reaction mixture is then heated to 70° and the excess ammonia and water is distilled off completely under vacuum.

The residue containing the polyglycol diamine is dissolved in 334 parts by water to form a fairly viscous approximately 50% aqueous solution.

The structure of the resulting polyglycol diamine corresponds to formula IIa wherein p is 13 or 14.

d. Concentrated aqueous precondensate

A 25% aqueous precondensate concentrate is produced by dissolving 19 parts (0.03 mols) of the polychlorohydrin ether described in part (a) above, in 19 parts of water and adding dropwise 75 parts (0.05 mols) of the polyglycol amine solution described in part (b) above, at 25° C. (weight ratio of compound of formula I to compound of formula II being 1:2). After stirring the mixture for 2 hours at 25° C., the solution is stabilised by acidification with concentrated hydrochloric acid to a pH of 6.0.

d. Antistatic treatment

The precondensate concentrate described in part (c) above is diluted with water to a concentration of 200 gm of the 25% precondensate condensate per liter of solution and the pH is adjusted to 6.2 by the addiition of sodium acetate. The resulting application liquor is applied to woven fabrics of polyester, polyacrylonitrile and polyamide in a padding machine, the liquor taken up being restricted by rolling or hydroextraction to a level of 70% based on the weight of the fabric. The treated material is then dried at 140° C. for 1 minute, curing of the treatment occurring simultaneously. The antistatically treated fabrics exhibit an increase in dry weight of 3.5%.

EXAMPLE 2

The compound of formula II is produced in the manner described in Example 1 part (b) except that instead of adding the polyglycol bis-epichlorohydrin ether to a mixture of sodium hydroxide and ammonia, the sodium hydroxide solution and then the ammonia solution are added to the polyglycol bis-epichlorohydrin ether dropwise at 10° to 15° C.

The procedures set out in Example 1 are otherwise followed.

EXAMPLE 3

Compounds of formula II are produced in the manner described in Example 1 part (b) except that the 300 parts (0.5 mols) of polyglycol 600 are replaced by 600 parts (0.5 mols) of polyglycol 1200 or 150 parts (0.5 mols) of polyglycol 300 in the reaction with 92.5 parts (1 mol) of epichlorohydrin.

The procedures set out in Example 1 are otherwise followed.

EXAMPLE 4 a. Compound of formula I

A polychlorohydrin ether of formula I is produced by alkoxylating 121 parts (1 mol) of tris-(hydroxymethyl)-aminomethane at 160°-175° with 660 parts (15 mols) of ethylene oxide. When alkoxylation is complete, 462 parts (5 mols) of epichlorohydrin and 2.1 parts of tin tetrachloride are added to the reaction mixture containing the resulting ethylene oxide adduct, the temperature being maintained at 95° to 100° C. throughout the reaction.

The structure of the compound produced corresponds to formula Ia wherein the sum of $m_1'$, $m_2'$, $m_3'$, $m_4'$ and $m_5'$ is 15.

b. Concentrated aqueous precondensate

A 25% aqueous precondensate concentrate is produced by dissolving 83 parts of the polychlorohydrin ether described in part (a) above, in a solvent mixture consisting of 153 parts of water and 53 parts of isopropanol and adding to the solution so obtained, dropwise at 25° C., 150 parts of the polyglycol amine solution described in Example 1 part (b) (weight ratio of compound of formula I to compound of formula II being 1:0.9). After stirring the mixture for 1 hour at 25°, the solution is stabilised by acidification with 8.5 parts of concentrated hydrochloric acid to a pH of 5.5.

c. Antistatic treatment

The precondensate concentrate described in part (b) above is diluted with water to a concentration of 200 gm of the 25% precondensate condensate per liter of solution and the pH is adjusted to 7.0 by the addition of 3 gm of sodium bicarbonate. The resulting application liquor is applied to polyester, polyacrylonitrile and polyamide woven fabrics in the manner described in Example 1 part (d). Increase in dry weight is 3.5%.

In a slight modification of part (a) of this Example, 450 parts of polyglycol amine solution are employed instead of 150 parts (the weight ratio of the compound of formula I to compound of formula II being 1:2.7).

EXAMPLE 5

A polychlorohydrin ether of formula I is produced in the manner described in Example 4 part (a) by the addition of 132 parts (3 mols) ethylene oxide and 462 parts (5 mols) of epichlorohydrin to 121 parts (1 mol) of tris-(hydroxymethyl)-amine methane. A concentrated aqueous precondensate is produced in the manner described in Example 4 part (b) except that 150 parts of the polychlorohydrin ether produced as described above are employed instead of 83 parts.

The procedure set out in Example 4 is otherwise followed.

EXAMPLE 6 a. Compound of formula I

A polychlorohydrin ether of formula I is produced by alkoxylating 242 parts (2 mols) of tris-(hydroxymethyl)-amine methane with 220 parts (5 mols) of ethylene oxide at a temperature between 160° to 175°. When alkoxylation is complete, 925 parts (10 mols) of epichlorohydrin and a catalytic amount of tin tetrachloride are added to the reaction mixture containing the resulting ethylene oxide adduct, the temperature being maintained at 95° to 100° C. throughout the reaction.

The structure of the compound produced corresponds to formula Ia wherein the sum of $m_1'$, $m_2'$, $m_3'$, $m_4'$ and $m_5'$ is 2 or 3.

b. Concentrated aqueous precondensate

A 25% aqueous precondensate concentrate is produced by dissolving 30 parts of the polychlorohydrin ether described in part (a) above, in a solvent mixture consisting of 55 parts of water and 20 parts of isopropanol and adding to the the resulting solution, dropwise, at 25° to 30°, 150 parts of the polyglycol amine solution described in Example 1 part (b) (weight ratio of compound of formula I to compound of formula II being 1:2.5). After stirring the mixture for 2 hours, the solution is stabilised by acidification with 8 parts of concentrated hydrochloric acid to a pH of 5.5.

c. Antistatic treatment

The precondensate concentrate described in part (b) above is diluted with water to a concentration of 200 gm of the 25% precondensate concentrate per liter of solution and the pH of the solution is adjusted to 6.9 by addition of 5 gm of sodium bicarbonate. The resulting application liquor is applied to polyester, polyacrylonitrile and polyamide woven fabrics in the manner described in Example 1 part (d).

In a slight modification of part (b) of this Example, the degree of condensation in the production of the precondensate is increased by heating the mixture to 80° for 4 hours, whereupon a pronounced increase in viscosity of the precondensate solution is observed, the solution still being homogeneous and well-stirrable.

EXAMPLE 7 a. Concentrated aqueous precondensate

The process of Example 4 part (b) is repeated employing 83 parts of the polychlorohydrin ether described in Example 4 part (a) and 80 parts of a 50% solution of a polyglycol diamine of the formula

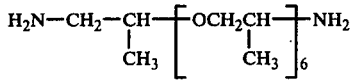

(the weight ratio of the compound of formula I to compound of formula II being 1:0.5) to produce a yellowish concentrated solution (25% concentrate).

b. Antistatic treatment

The precondensate concentrate produced as described in part (a) above is diluted with water to a concentration of 200 gm of the 25% precondensate concentrate per liter of solution and the pH is adjusted to 6.0 by the addition of sodium acetate. The resulting application liquor is applied to polyester, polyacrylonitrile and polyamide woven fabics in the manner described in Example 1 part (d).

EXAMPLE 8 a. Compound of formula II

A polyglycol diamine of formula II is produced by alkoxylating 125 parts (0.5 mol) of dihydroxy diphenyl sulphone with 330 parts (7.5 mols) of ethylene oxide at 220° to 240°. To the brown viscous liquid so produced, is added 2 parts of tin tetrachloride and 37 parts (0.4 mol) epichlorohydrin and the mixture reacted at 70°. When the reaction is complete, the reaction mixture is cooled to 20° to 25° and 51 parts of a 30% aqueous sodium hydroxide solution and 55 parts of a 25% aqueous ammonia solution added thereto. After the amination, the excess ammonia is removed by heating to 70°. The residue is dissolved in water to produce a 50% aqueous solution of the polyglycol diamine.

b. Concentrated aqueous precondensate

A 25% aqueous precondensate concentrate is produced by dissolving 83.5 parts of the polychlorohydrin ether described in Example 4 part (a), in a solvent mixture consisting of 40 parts of water and 55 parts of isopropanol. 223 Parts of the 50% polyglycol diamine solution described in part (a) above is added to the resulting solution (the weight ratio of the compound of formula I to the compound II being 1:1.3), dropwise at 20° to 25° and the mixture stirred for 2 hours. The pH of the mixture is then adjusted to 5.6 by the addition of 9.4 ml concentrated hydrochloric acid.

c. Antistatic treatment

The precondensate concentrate described in part (b) above is diluted with water to a concentration of 100 parts of the 25% aqueous precondensate per liter of solution and 15 parts of sodium acetate added per liter of solution giving a pH value of 6.5. The almost neutral application liquor so produced is applied to polyester, polyacrylonitrile and polyamide woven fabrics in accordance with the procedure described in Example 1 part (d), the antistatic treatment resulting in an increase in 1.7% in the dry weight of the treated fabrics.

EXAMPLE 9 a. Compound of formula I

A polychlorohydrin ether of formula I is produced by alkoxylating 60 parts (0.5 mol) of tris-(hydroxymethyl)-aminomethane with 110 parts (2.45 mols) of ethylene oxide at a temperature between 160° and 175°. When alkoxylation is complete, 231 parts (2.15 mols) of epichlorohydrin and a catalytic amount of tin tetrachloride are added to the reaction mixture containing the resulting ethylene oxide adduct, the temperature being maintained at 95° to 100° C.

The structure of the compound produced corresponds approximately to formula I wherein $n_1$ to $n_5$ are each 0, the sum of $m_1$ to $m_5$ is 5, $X_1$ and $X_2$ are each ethylene and $Y_1$ is hydrogen or $$-CH_2-\overset{\overset{\displaystyle OH}{|}}{CH}-CH_2Cl$$

and $Y_2$ is $$-CH_2-\overset{\overset{\displaystyle OH}{|}}{CH}-CH_2Cl.$$

b. Concentrated aqueous precondensate

A 25% aqueous precondensate concentrate is produced by dissolving all of the polychlorohydrin ether produced as described in part (a) above, in a solvent mixture consisting of 700 parts of water and 240 parts of isopropanol and adding thereto, dropwise, 300 parts of the polyglycol diamine described in Example 1 part (b), (the weight ratio of the compound of formula I to the compound of formula II being 1:0.4), the mixture being stirred for 4 hours at 25° to 30°. The 25% concentrate so obtained is stabilised by the addition of concentrated hydrochloric acid to obtain a pH of 5.5.

c. Antistatic treatment

The precondensate condensate described in part (b) above is diluted with water to a concentration of 200 parts of the 25% aqueous precondensate per liter of solution and the solution so produced is rendered weakly acidic to neutral (pH 5.2) by the addition of sodium acetate. The resulting application liquor is applied to polyester, polyacrylonitrile and polyamide woven fabrics in accordance with the procedure described in Example 1 part (d).

EXAMPLE 10 a. Compound of formula I

A polychlorohydrin ether of formula I is produced by alkoxylating 121 parts (1 mol) of tris-(hydroxymethyl)aminomethane with 660 parts (15 mols) of ethylene oxide followed by 277.5 parts (3 mols) of epichlorohydrin in the manner described in Example 1 part (a).

The structure of the compound produced corresponds to formula I wherein $n_1$ to $n_3$ are each 0, the sum of $m_1$ to $m_5$ is 15, $X_1$ to $X_5$ are each 1,2-ethylene, and $Y_1$ and $Y_2$ are each hydrogen.

b. Compound of formula II

A polyglycol diamine of formula II is produced by condensing a polyethylene glycol, derived from 14 units of ethylene oxide, with epichlorohydrin in a molar ratio of 1:2 and converting the resulting dichloro product into the corresponding diamine, in the manner described in Example 1 part (b).

The structure of the compound produced corresponds to formula II*a* wherein p is 14.

c. Concentrated aqueous precondensate

The compounds produced as described in (a) and (b) above are reacted together in aqueous solution in a molar ratio of compound of formula I to compound of formula II of 1:1.5, i.e. in a weight ratio of 1:1, respectively, in the manner described in Example 1 part (c), Example 4 part (b), Example 6 part (b), Example 7 part (a), Example 8 part (b) or Example 9 part (b).

d. Antistatic treatment

The precondensate concentrate described in part (c) above is diluted with water and applied to woven fabrics of polyester, polyacrylonitrile and polyamide in the manner described in Example 1 part (d).

What is claimed is:

1. As an antistatic composition, an aqueous solution containing 1 to 10% by weight of: (a) a mixture of at least one compound of formula I,

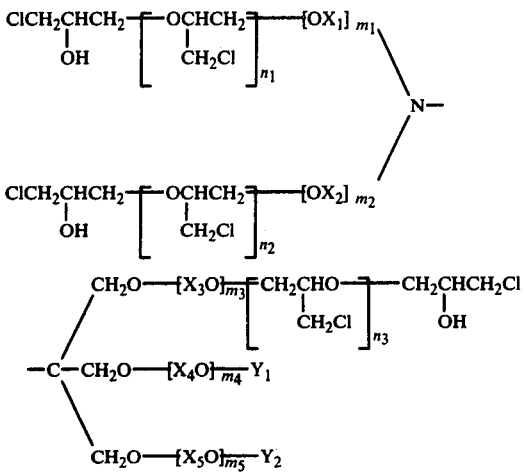

I wherein $X_1$, $X_2$, $X_3$, $X_4$ and $X_5$ are each, independently, 1,2-ethylene, 1,2-propylene or 1,2-butylene, $m_1$ and $m_2$ are each, independently, an integer 1 to 30, $m_3$, $m_4$ and $m_5$ are each, independently, 0 or an integer 1 to 30, $n_1$, $n_2$ and $n_3$ are each, independently, 0 or an integer 1 or 2, $Y_1$ is hydrogen or a radical of the formula

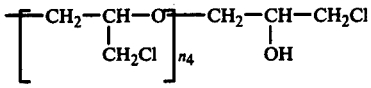

wherein $n_4$ is 0 or an integer 1 or 2, and $Y_2$ is hydrogen or a radical of the formula

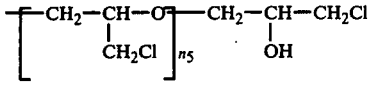

wherein $n_5$ is 0 or an integer 1 or 2, and wherein the sum of $m_1$, $m_2$, $m_3$, $m_4$ and $m_5$ is an integer 2 to 100 and the sum of $n_1$, $n_2$, $n_3$, $n_4$ and $n_5$ is 0 or an integer 1 to 7, and at least one compound of formula II,

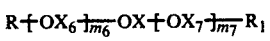

II wherein

R is a radical of the formula

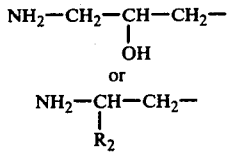

wherein $R_2$ is hydrogen, methyl or ethyl, $R_1$ is $NH_2$— or a radical of the formula

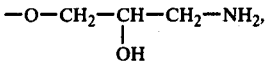

X is alkylene of 2-12 carbon atoms, phenylene, phenyleneoxyphenylene or phenylenesulphonylphenylene, $X_6$ and $X_7$ are each, independently, 1,2-ethylene, 1,2-propylene or 1,2-butylene, and $m_6$ and $m_7$ are each, independently, an integer 1 to 38, the sum of $m_6$ and $m_7$ being an integer 2 to 39, (b) a precondensate of at least one compound of formula I and at least one compound of formula II, (c) a mixture of a precondensate of at least one compound of formula I and at least one compound of formula II, and at least one compound of the formula I or at least one compound of the formula II, or (d) a mixture of a precondensate of at least one compound of formula I and at least one compound of formula II, and at least one compound of the formula I and at least one compound of the formula II, said aqueous solution having a pH of 5.5 to 7.0.

2. A composition according to claim 1, wherein in formula I, the sum of $m_1$, $m_2$, $m_3$, $m_4$ and $m_5$ is an integer 2 to 20.

3. A composition according to claim 1, wherein in formula I, $X_1$, $X_2$, $X_3$, $X_4$ and $X_5$ are each, independently, 1,2-ethylene or 1,2-propylene.

4. A composition according to claim 3, wherein each of $X_1$, $X_2$, $X_3$, $X_4$ and $X_5$ is 1,2-ethylene.

5. A composition according to claim 1, wherein in formula I, $n_1$, $n_2$, $n_3$, $n_4$ and $n_5$ are each 0.

6. A composition according to claim 1, wherein in formula II, each of X, $X_6$ and $X_7$ is, independently, 1,2-ethylene or 1,2-propylene.

7. A composition according to claim 6, wherein each of X, $X_6$ and $X_7$ is 1,2-ethylene.

8. A composition according to claim 1, wherein in formula II, the sum of $m_6$ and $m_7$ is an integer 4 to 22.

9. A composition according to claim 1, wherein in formula II, R is a radical

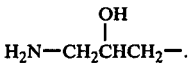

10. A composition according to claim 1, wherein in formula II, $R_1$ is a radical

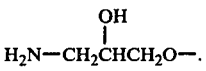

11. A composition according to claim 1, wherein the weight ratio of a compound or a mixture of compounds of formula I to a compound or a mixture of compounds of formula II is 1:0.4 to 3.

12. A composition according to claim 1, wherein the compounds of formula I and II, or mixtures thereof, are at least partially in precondensate form.

13. As an antistatic composition in concentrated form, an aqueous solution containing 10 to 50% by weight of: (a) a mixture of at least one compound of formula I,

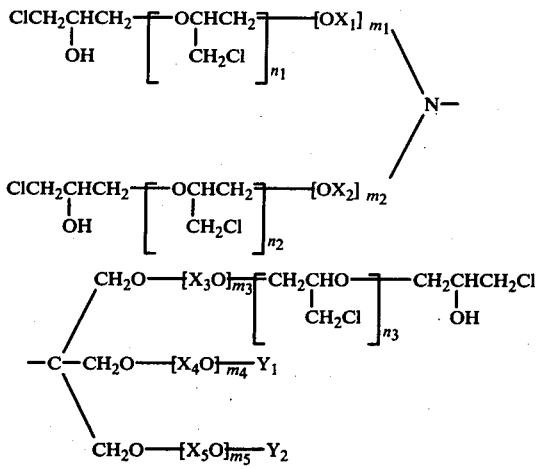

I wherein $X_1$, $X_2$, $X_3$, $X_4$ and $X_5$ are each, independently, 1,2-ethylene, 1,2-propylene or 1,2-butylene, $m_1$ and $m_2$ are each, independently, an integer 1 to 30, $m_3$, $m_4$ and $m_5$ are each, independently, 0 or an integer 1 to 30, $n_1$, $n_2$ and $n_3$ are each, independently, 0 or an integer 1 or 2, $Y_1$ is hydrogen or a radical of the formula

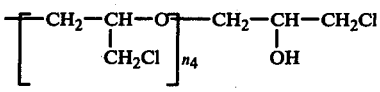

wherein $n_4$ is 0 or an integer 1 or 2, and $Y_2$ is hydrogen or a radical of the formula

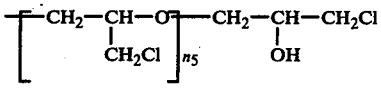

wherein $n_5$ is 0 or an integer 1 or 2, and wherein the sum of $m_1$, $m_2$, $m_3$, $m_4$ and $m_5$ is an integer 2 to 100 and the sum of $n_1$, $n_2$, $n_3$, $n_4$ and $n_5$ is 0 or an integer 1 to 7, and at least one compound of formula II,

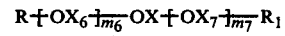

II wherein R is a radical of the formula

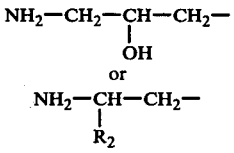

wherein $R_2$ is hydrogen, methyl or ethyl, $R_1$ is $NH_2$— or a radical of the formula

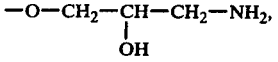

X is alkylene of 2–12 carbon atoms, phenylene, phenyleneoxyphenylene or phenylenesulphonylphenylene, $X_6$ and $X_7$ are each, independently, 1,2-ethylene, 1,2-propylene or 1,2-butylene, and $m_6$ and $m_7$ are each, independently, an integer 1 to 38, the sum of $m_6$ and $m_7$ being an integer 2 to 39, (b) a precondensate of at least one compound of formula I and at least one compound of formula II, (c) a mixture of a precondensate of at least one compound of formula I and at least one compound of formula II, and at least one compound of the formula I or at least one compound of the formula II, or (d) a mixture of a precondensate of at least one compound of formula I and at least one compound of formula II, and at least one compound of the formula I and at least one compound of the formula II, said aqueous solution having a pH below 7.0.

14. A composition according to claim 13, wherein in formula I, the sum of $m_1$, $m_2$, $m_3$, $m_4$ and $m_5$ is an integer 2 to 20.

15. A composition according to claim 13, wherein in formula I, $X_1$, $X_2$, $X_3$, $X_4$ and $X_5$ are each, independently, 1,2-ethylene or 1,2-propylene.

16. A composition according to claim 15, wherein each of $X_1$, $X_2$, $X_3$, $X_4$ and $X_5$ is 1,2-ethylene.

17. A composition according to claim 13, wherein in formula I, $n_1$, $n_2$, $n_3$, $n_4$ and $n_5$ are each 0.

18. A composition according to claim 13, wherein in formula II, each of X, $X_6$ and $X_7$ is, independently, 1,2-ethylene or 1,2-propylene.

19. A composition according to claim 18, wherein each of X, $X_6$ and $X_7$ is 1,2-ethylene.

20. A composition according to claim 13, wherein in formula II, the sum of $m_6$ and $m_7$ is an integer 4 to 22.

21. A composition according to claim 13, wherein in formula II, R is a radical

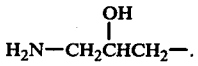

22. A composition according to claim 13, wherein in formula II, $R_1$ is a radical

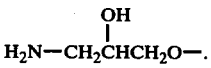

23. A composition according to claim 13, wherein the weight ratio of a compound or a mixture of compounds of formula I to a compound or a mixture of compounds of formua II is 1:0.4 to 3.

24. A composition according to claim 13, wherein the compounds of formulae I and II, or mixtures thereof, are at least partially in precondensate form.

* * * * *